US006093247A

United States Patent [19]

Sipos et al.

[11] Patent Number: 6,093,247

[45] Date of Patent: Jul. 25, 2000

[54] DISTRIBUTION SYSTEM FOR APPLYING A VISCOUS MATERIAL TO A ROOF

[75] Inventors: Jeffrey J. Sipos, Austintown; Anthony R. Vross, Canfield; Timothy R. Tarr, Youngstown, all of Ohio

[73] Assignee: National Tool & Equipment, Inc., Boardman, Ohio

[21] Appl. No.: 08/957,005

[22] Filed: Oct. 23, 1997

[51] Int. Cl.[7] ..... B05C 5/02

[52] U.S. Cl. ..... 118/302; 118/323; 239/124; 239/127; 239/135; 222/108; 222/110; 222/424; 404/95; 404/111

[58] Field of Search ..... 118/302, 323; 239/124, 127, 135; 222/108, 109, 110, 424; 427/345, 422, 186, 138; 404/95, 111

[56] References Cited

U.S. PATENT DOCUMENTS

| | | | |
|---|---|---|---|
| 2,645,524 | 7/1953 | Kelly . | |
| 2,773,496 | 12/1956 | Czarnecki | 126/343.5 |
| 3,773,303 | 11/1973 | Griffith | 366/4 |
| 4,620,645 | 11/1986 | Hale | 222/146.2 |
| 4,944,632 | 7/1990 | Dillingham | 404/111 |
| 5,239,615 | 8/1993 | Moore et al. | 392/441 |
| 5,591,244 | 1/1997 | Vross et al. | 55/356 |

*Primary Examiner*—Laura Edwards
*Attorney, Agent, or Firm*—Sand & Sebolt

[57] ABSTRACT

A system and method for supplying and distributing a viscous material onto a roof include a mobile vessel containing a supply of the material for location either on the roof or on the ground adjacent the building. A delivery conduit extends from a viscous material storage chamber in the vessel to a secondary vessel or to a material application tool on the roof. A heater is located on the vessel to heat the supply of material. A reversible pump and/or motor delivers the viscous material from the storage chamber through the conduit for subsequent application on the roof and pumps unused material through the conduit and into the storage chamber to maintain the temperature of the material and to prevent the material from hardening in the various conduits, supply lines and equipment. A bypass line extends between the conduit and storage chamber for return of the material by gravity to the chamber in the event of pump or motor failure. The conduit has a heating device for maintaining the temperature of the conduit to limit frictional losses.

8 Claims, 4 Drawing Sheets

31
31
10
35
33
34
30
30
45
26
25
43
20
1
43
44
4
47
40
23
24
9
17
6
3
3
2

DISTRIBUTION SYSTEM FOR APPLYING A VISCOUS MATERIAL TO A ROOF

BACKGROUND OF THE INVENTION

1. Technical Field

The invention relates generally to roof coating applications. More particularly, the invention relates to an improved method and apparatus for delivering hot bituminous material from a vessel containing the material onto a roof for a subsequent application coating thereto. Even more particularly, the invention relates to such a method and apparatus which uses a pumping arrangement whereby the unused or cooled but still liquid bituminous material can be returned easily to a heated storage chamber for reheating to ensure that the material has the desired temperature and to prevent clogging of the delivery pipe and associated equipment upon cooling of the material.

2. Background Information

Various processes and apparatus have been developed for applying a heated roofing material, usually a hot bitumen, which is mopped or sprayed onto a roof for adhering of a roof covering thereon. This bitumen is usually heated in a mobile vessel located on the ground adjacent the building in which either a new roof is being applied or an existing roof is being reroofed. These vessels are referred to in the roofing industry generally as roofing kettles. One example of such a kettle is shown in pending application Ser. No. 08/768,963. These roofing kettles usually contain a storage chamber which is heated, usually with propane or natural gas heaters, which melts the hardened blocks of bitumen and maintains the resulting liquid at the desired elevated temperature. The heated bitumen is then pumped to the roof site through a conduit where it is usually deposited into a smaller mobile vessel, generally referred to in the industry as a roof lugger. In certain applications, the delivery conduit may be connected directly to a mop or spray applicator for direct application of the heated material to the roof. After the bitumen is applied to the roof, a covering which generally comes in roll form is applied and adhered thereto by the bitumen with the subsequent application of a ballast such as gravel.

One problem that always occurs in the use of such heated bitumen is that if the application of the heated roofing material is not continuous the bitumen will cool and at times harden in the delivery conduit or in the roof lugger or application tool making it an unsatisfactory roofing installation and requiring the cleaning and/or disposal of the equipment and tools in which the bitumen has hardened.

This can occur due to work stoppage on the roof for various reasons such as the unavailability of the rolls of roofing material, breaks by the working personnel or numerous other reasons causing a delay in the application of the heated roofing material. Furthermore, at the end of a work shift or roofing job, the excess material then must be returned by some manner to the ground where it hardens and then is disposed of or returned to the kettle for reuse the next day or at another job site. This becomes difficult and time consuming.

There is no known method and apparatus of which we are aware which enables the material to be delivered directly to the roof from a roofing kettle usually located at the ground, which also is provided with a pumping mechanism enabling the excess material to be returned to the heated kettle to prevent hardening of the material within the delivery pipe or roof lugger or application tool.

SUMMARY OF THE INVENTION

Objectives of the invention include providing an apparatus and method which will pump hot bitumen or other roofing material directly to the work area on a roof eliminating intermediate transfer devices, and which pumps cooled unsatisfactory material back into the kettle for reprocessing and reheating in a very simple, effective and inexpensive manner.

Another objective of the invention is to provide such a system and method which provides for the return of the heated bitumen or roofing material to the kettle even should the delivery pump fail by providing a return bypass which returns the cooled material by gravity into the storage chamber of the roofing kettle.

A still further objective of the invention is to provide such a system and method which eliminates clogging of delivery conduit and build-up of the material in various feed lines and conduits, and which includes an auxiliary heating means for the delivery conduit to assist in maintaining the temperature of the heated conduit to reduce flow friction thereby allowing residual bitumen to be more fully removed by the pump.

Another objective of the invention is to provide a system and method for delivering the heated material from a kettle on the ground either to a lugger on the roof or directly to an applicator tool for applying the material to the roof.

These objectives and advantages of the invention are obtained by the improved system of the present invention, the general nature of which may be stated as a system for the distribution of heated roofing material onto a roof including a vessel having a storage chamber adapted to contain a quantity of the heated material; a conduit communicating with said storage chamber for delivering the heated material to the roof for subsequent application to the roof; and pump means mounted on the vessel and communicating with the conduit for selectively pumping the heated material from the storage chamber and through the conduit to the roof and for returning the heated material from within the conduit back into said storage container.

These objectives and advantages are further obtained by the method of the present invention, the general nature of which may be stated as a method for applying a heated material onto a roof including providing a vessel containing a supply of the heated material and a delivery conduit extending from the vessel for delivery of the material to the roof for subsequent application on the roof; pumping the heated material from the vessel in a first direction through the delivery conduit on the roof; and pumping the heated material in a second direction through the delivery conduit from the roof and back into the vessel for returning cooled material back into the vessel.

BRIEF DESCRIPTION OF THE DRAWINGS

The preferred embodiment of the invention, illustrative of the best mode in which applicants have contemplated applying the principles, is set forth in the following description and is shown in the drawings and is particularly and distinctly pointed out and set forth in the appended claims.

Similar numerals refer to similar parts throughout the drawings.

DESCRIPTION OF PREFERRED EMBODIMENT

Figure 1:
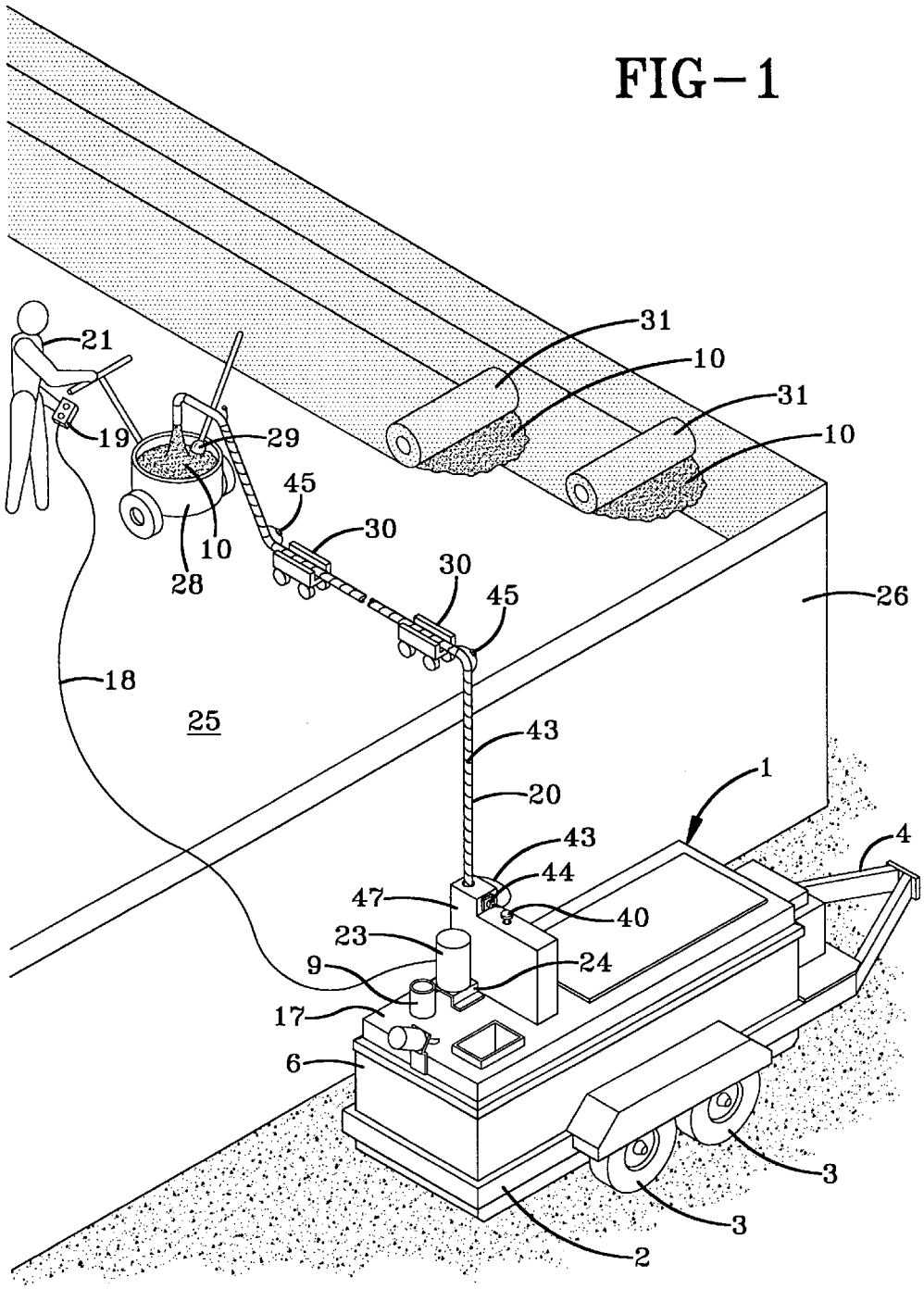
FIG. 1 is a diagrammatic perspective view showing one manner in which the improved distribution system and method will be utilized for a roofing application.

FIG. 1 illustrates a typical application in which the improved system and method of the present invention will be utilized. A mobile vessel indicated generally at 1, usually referred to in the industry as a roofing kettle, includes a trailer 2 mounted on wheels 3 to provide mobility thereto. Trailer 2 usually will be provided with a draw bar 4 for attachment to a towing vehicle or could have its own power drive mechanism if desired. One type of vessel is shown in greater detail in pending U.S. patent application Ser. No. 08/768,963. However, various other types of less detailed kettles can be utilized without affecting the concept of the invention. Vessel 1 will usually have an insulated outer housing 6 as shown particularly in FIGS. 3 and 4, with a hollow material storage chamber 7 formed therein. Heating usual heating pipes 9 are mounted within storage chamber 7 for heating a supply of roofing material 10 contained therein. Material 10 preferably will be an asphalt or a bituminous type of material of the type used for most roofing applications, although other types of materials can be used without affecting the concept of the invention.

Figure 4:
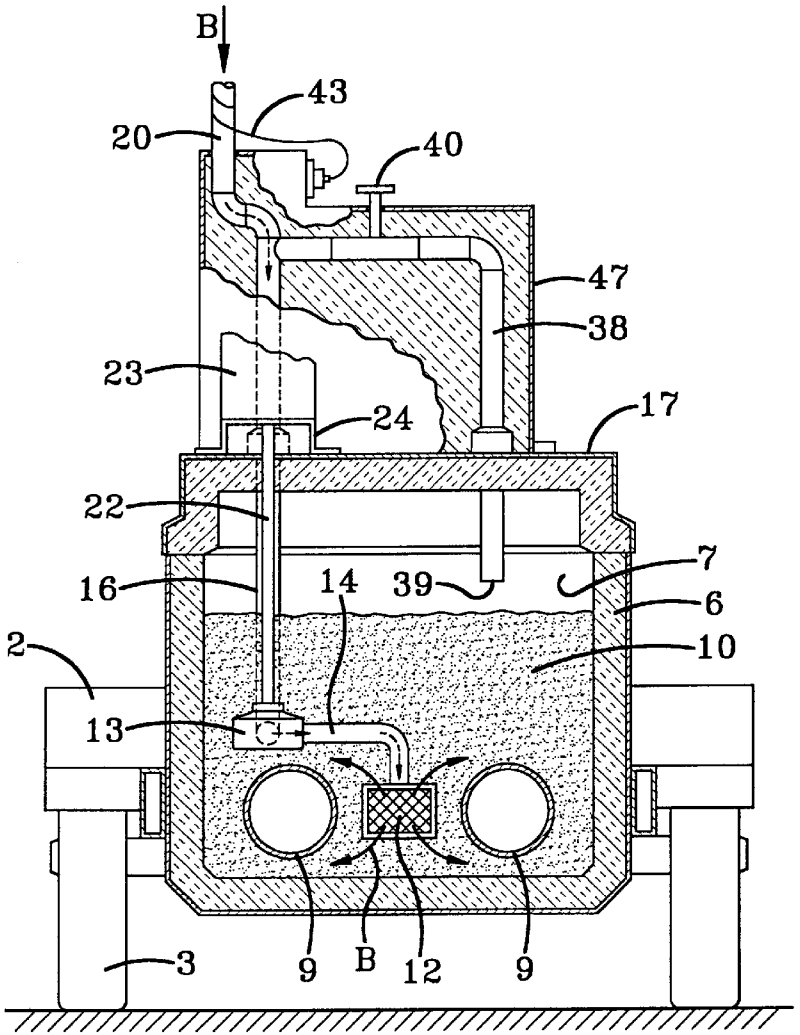
FIG. 4 is a view similar to FIG. 3 showing the cooled liquid material being returned from the roof and back into the heated storage chamber of the kettle.
Figure 3:
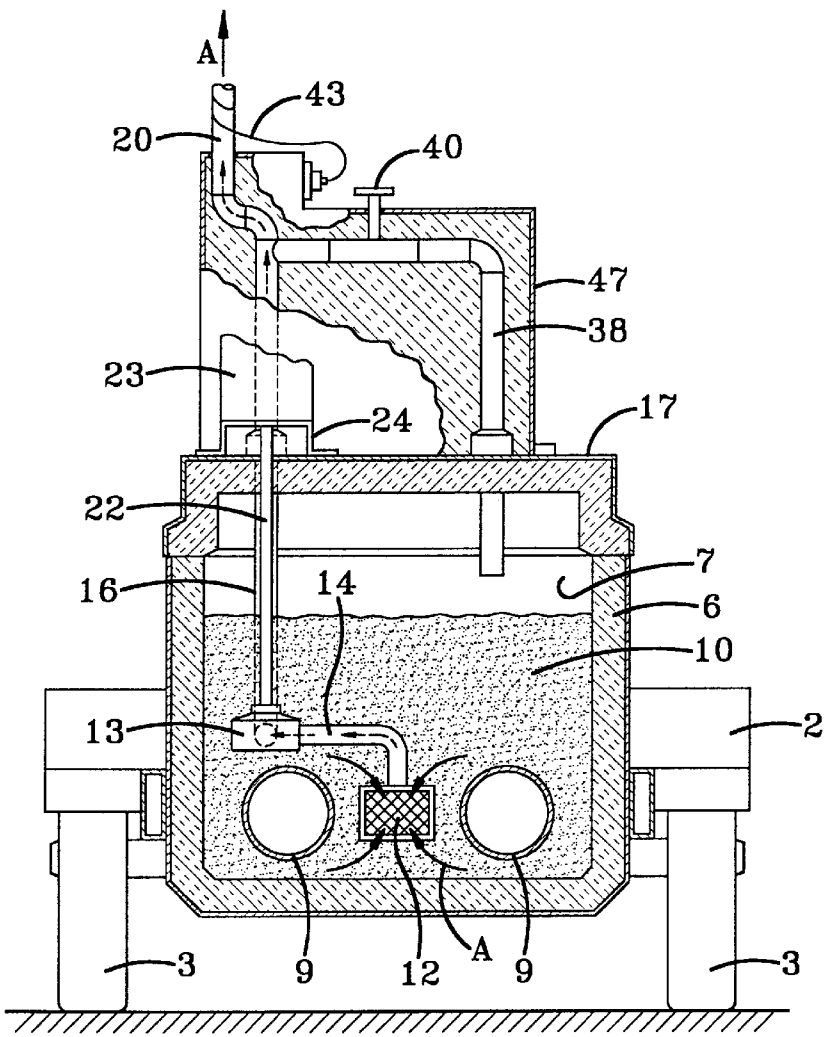
FIG. 3 is an enlarged cross-sectional view showing the hot liquid material contained within the storage chamber of a mobile vessel being pumped from the vessel to a roof top for application thereon.

An inlet 12 is located generally adjacent the bottom of storage chamber 7 and is connected to a pump 13 by a delivery line 14 (FIGS. 3 and 4). An outlet pipe 16 extends upwardly from pump 13 and through roof 17 of housing 6 for subsequent connection to a delivery conduit 20. Pump 13 may be actuated by a shaft 22 connected to a power unit or motor 23 which is mounted by a bracket 24 on roof 17. Motor 23 and pump 13 preferably are controlled by an operator 21 at roof level by a control box 19 which is operatively connected to the motor and pump by a control line 18. The return of material is either manually or automatically activated.

Figure 2:
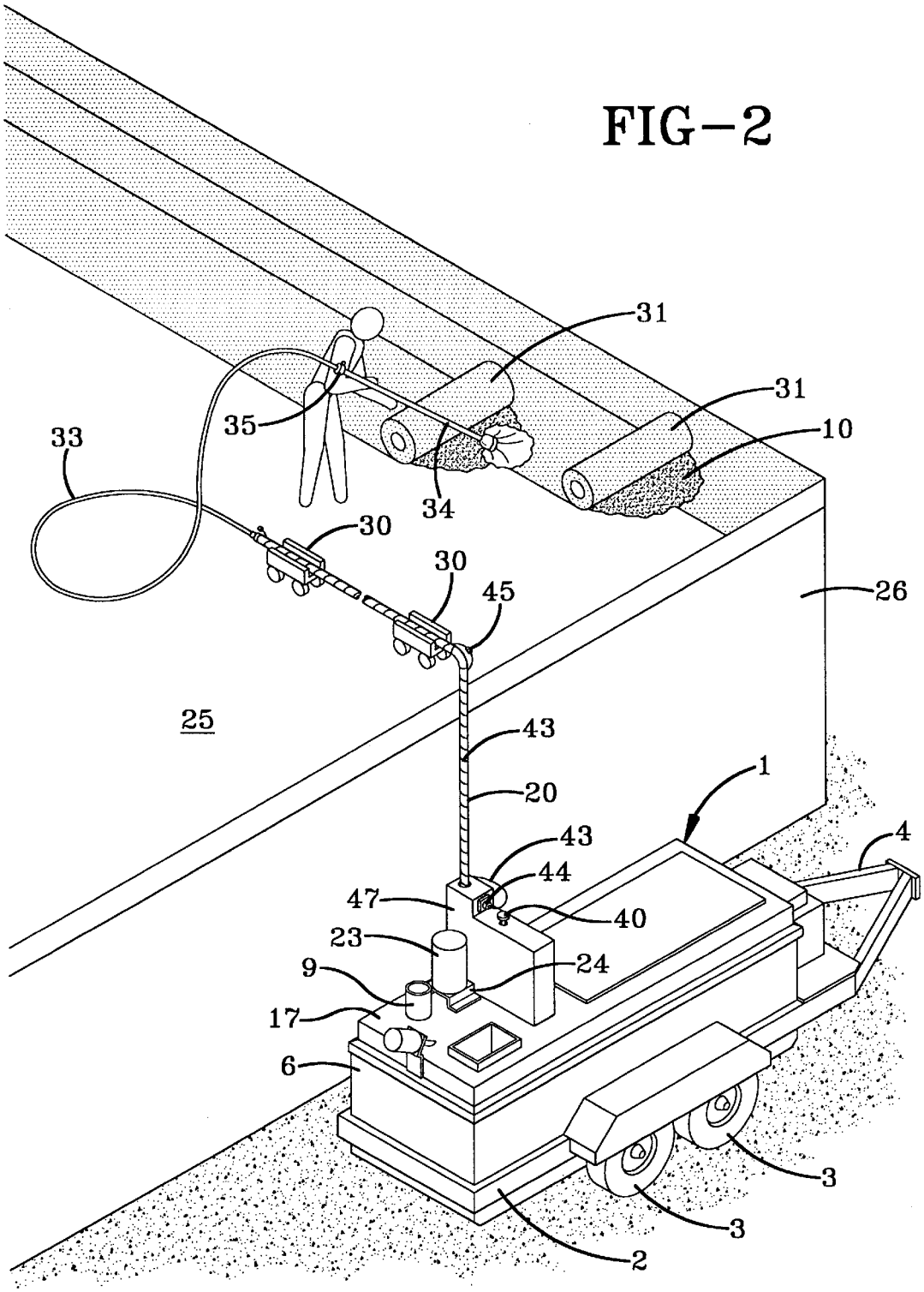
FIG. 2 is a view similar to FIG. 1 showing another manner in which improved roofing system and method will be utilized and carried out.

As shown in FIGS. 1 and 2, delivery conduit 20 will extend from mobile vessel 1 onto a roof 25 of a building 26. In the embodiment shown in FIG. 1, the heated material 10 is delivered to a portable carrier 28, usually referred to in the roofing industry as a roof lugger. The lugger then is moved to various locations on the roof for subsequent application of the heated material, such as by an application mop 29, afterwhich strips of roofing material 31 are unwound and secured to the roof. A plurality of support dollies 30 may be located on roof 25 for movably supporting delivery conduit 20.

Another application is shown in FIG. 2 wherein delivery conduit 20 is connected to a hose 33 which is connected directly to a spray wand 34 having a manually controlled ON/OFF valve 35 for directly spraying or applying the heated material 10 onto roof 25.

In accordance with the main feature of the invention, pump 13 will be a reversible pump and/or motor 23, whereby the material will be drawn through inlet 12 in the direction of arrows A (FIG. 3) for movement in a first direction through conduit 20 for discharge into lugger 28 (FIG. 1) or for direct application to the roof as shown in FIG. 2. However, upon reversing of motor 23 and correspondingly of pump 13, the heated material will move in the direction of arrows B as shown in FIG. 4, where it is returned through conduit 20, and delivery lines 16 and 14 and through inlet 12 back into storage chamber 7 where it is reheated and reused with the heated material 10.

Thus, should the heated material in delivery conduit 20 or in roof lugger 28 becomes too cool it can be withdrawn and pumped back into the kettle by simply reversing the direction of pump 13, usually by actuating reversible motor 23. Thus, all of the material will be pumped back into storage chamber 7 for recirculating and reheating with material 10 by heaters 9. This could occur at the end of a work shift, at a lunch break, or should the application of the roofing material be stopped at any time for various reasons. It requires very little work on the part of the workers other than the actuation of reversible motor 23 and pump 13. If material is not being pumped up to the roof through conduit 20, pump 13 automatically reverses, preferably for about 45 seconds, to clear conduit 20 of the material.

In further accordance with the invention, a bypass line indicated at 38, extends from an upper end of pipe 16 and through an opening in roof 17 and terminates at a discharge opening 39 which will generally terminate above the usual level of heated material 10 within storage chamber 7. A manually controlled one way valve 40 will be mounted in bypass line 38 and will be opened when there is a malfunction of pump 13 or motor 23. This will enable the heated, but now cooled material, to flow in the direction of arrow B through pipe 38 and into storage chamber 7 by gravity. During the normal reversing operation of pump 13, valve 40 will be closed ensuring that all of the material is being pumped back into the storage chamber through pipe 16 and 14 and then out through inlet 12. This bypass can be used to vary the delivery pressure to the applicator, such as a spray wand 34, at the ground level, allowing the operator to concentrate on ON-OFF control only, if desired.

In accordance with another feature of the invention, delivery conduit 20 is provided with auxiliary heating means such as an electric heating cable 43, which is wrapped about conduit 20 and connected to an electric power source at 44, for heating delivery conduit 20 in order to assist in maintaining the temperature of conduit 20 to minimize frictional losses in pipe. Preferably the conduit is heated at a maximum of 20 watts/ft which allows approximately 80% of the material to flow back into the storage chamber 7. A plurality of quick-connect electric connectors 45 are provided for achieving various lengths of heating cable to correspond with the length of delivery conduit 20.

Also to assist in maintaining the desired temperature within the various delivery pipes, a housing 47, which preferably is insulated, is mounted on roof 17 of mobile vessel 1 and encloses delivery pipe 16 and bypass line 38. Housing 47 could be uninsulated if desired and heated by the heat trapped within the top of storage chamber 7.

Figure 6:
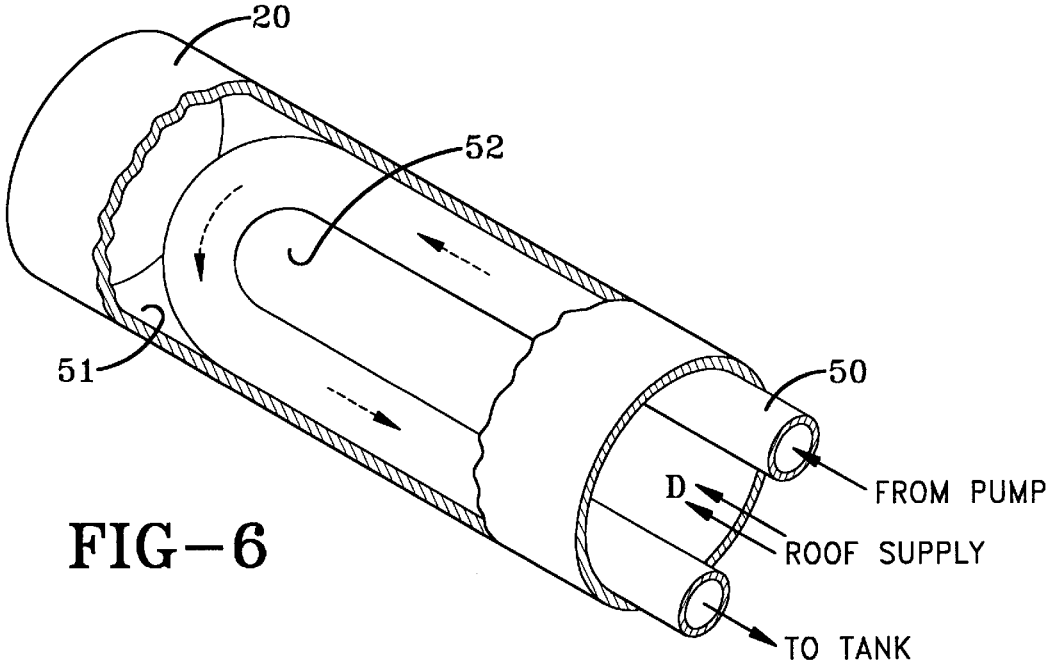
FIG. 6 is an enlarged fragmentary view with portions broken away and in section showing an auxiliary heater for maintaining the temperature of the heated roofing material as it flows from the heated kettle through the conduit and onto the roof.

Another type of auxiliary heating means is shown particularly in FIG. 6, and includes a circulating tube 50 which extends throughout a predetermined length of conduit 20 within the interior thereof. An auxiliary pump (not shown) is located at the lower or entrance end of tube 50, which communicates with the supply of heated material within storage chamber 7, and pumps and recirculates a small quantity of the heated material through circulating tube 50 which will then heat interior 52 of conduit 20, through which the main supply of roofing material 10 is flowing as shown by arrows D. As an example, conduit 20 will have an outside diameter (OD) of approximately 2 inches with the OD of tube 50 being ½ inch thereby providing a sufficient cross-sectional area within conduit 20 for the passing of the heated material therethrough, yet provide a sufficient flow of the auxiliary heated material to maintain the material at its desired temperature.

A low friction material 51 may be applied to the inside surface of delivery conduit 20 to assist in the flow of the heated material therethrough. One type of low friction material is sold under the trademark Teflon although other types could be utilized without affecting the concept of the invention. Also, delivery tube 20 could be insulated with a calcium silicant of fiberglass wrapping or the like eliminating the use of heating cable 43 and interior circulating tube 50 without affecting the concept of the invention.

Figure 5:
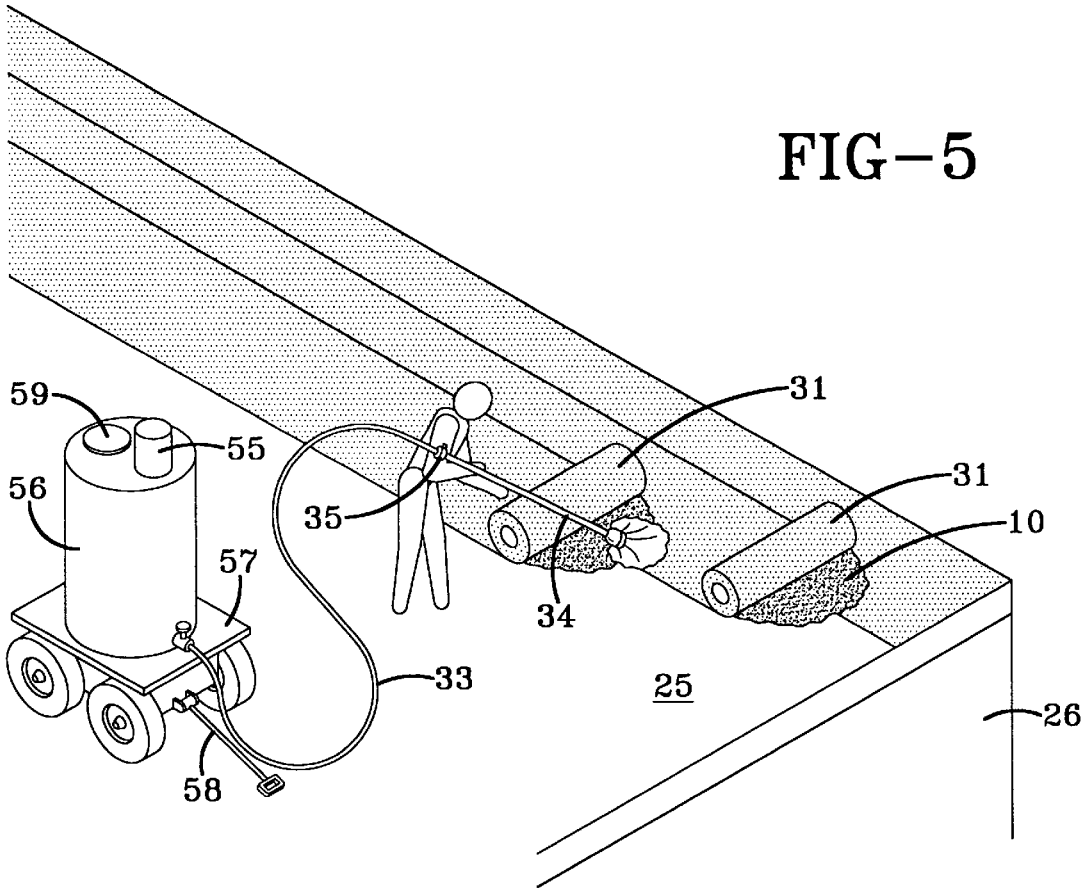
FIG. 5 is a diagrammatic perspective view showing another manner in which the improved heated roofing material distribution system and method will be utilized and carried out for a roofing application.

FIG. 5 shows another type of insulation in which a reversible pump and/or motor indicated generally at 55, which will be considerable smaller and less powerful than pump 13 and motor 23, is mounted on an insulated container 56. Container 56 is supported on a mobile carrier 57 and is connected to hose 33 and wand 34 for direct application to roof 25. Carrier 57 may be manually moved by a handle 58 to desired locations on the roof and may eliminate the use of the larger mobile vessel or kettle 1 at the ground level. In the alternative, container 56 may be connected to vessel 1 by delivery conduit 20 and once filled with the heated material will be maintained at a desired temperature by heating unit 59 contained within the container.

Accordingly, the improved distribution system and method is simplified, provides an effective, safe, inexpensive, and efficient device and sequence of operation which achieves all the enumerated objectives, provides for eliminating difficulties encountered with prior devices and methods, and solves problems and obtains new results in the art.

In the foregoing description, certain terms have been used fro brevity, clearness and understanding; but no unnecessary limitations are to be implied therefrom beyond the requirement of the prior art, because such terms are used for descriptive purposes and are intended to be broadly construed.

Moreover, the description and illustration of the invention us by way of example, and the scope of the invention is not limited to the exact details shown or described.

Having now described the features, discoveries and principles of the invention, the manner in which the improved distribution system and method is constructed, used and carried out, the characteristics of the system and method, and the advantageous, new and useful results obtained; the new and useful structures, devices, elements, arrangements, parts, combinations and method steps, are set forth in the appended claims.

What is claimed is:

1. A system for the distribution of heated viscous roofing material onto a roof, the system including:

a vessel having a storage chamber, said storage chamber being adapted to contain a quantity of the viscous material;

a heater disposed within said storage chamber;

a conduit communicating with said storage chamber for delivering the viscous material to the roof for subsequent application to the roof;

a reversible pump mounted on the vessel and communicating with the conduit, said pump selectively pumping the viscous material from the storage chamber and through the conduit to the roof;

a return line extending between the conduit and the storage chamber for returning the viscous material to the storage chamber in the event of failure of the pump;

a control valve disposed in the return line for controlling the flow of viscous material through the return line and into the storage chamber;

an electric heating cable mounted on the conduit; and a mobile carrier adapted to be located on the roof and in selected communication with a disk charge outlet of the conduit.

2. The system a s set forth in claim 1, further comprising an inlet disposed within the storage chamber and in fluid communication with the pump, said inlet adapted to supply viscous material to the conduit.

3. The system as set forth in claim 1, further comprising a circulating tube disposed within the interior of the conduit, the circulating tube adapted to recirculate viscous material between the storage chamber and the conduit.

4. The system as set forth in claim 1, further comprising an insulated housing enclosing the return line.

5. The system as set forth in claim 1, wherein the conduit includes an inside surface, and further comprising a low friction coating material disposed on the inside surface of the conduit.

6. The system as set forth in claim 1, wherein the control valve is a one-way valve.

7. The system as set forth in claim 1, further comprising an applicator tool attached to the discharge outlet of the conduit, the applicator tool adapted to apply the viscous material onto the roof.

8. The system as set forth in claim 1, further comprising wheel means disposed on the vessel for movably supporting the vessel.

* * * * *